US005243305A

United States Patent [19]

D'Oro et al.

[11] Patent Number: 5,243,305

[45] Date of Patent: Sep. 7, 1993

[54] METHOD TO MAKE MICROWAVE COUPLER WITH MAXIMAL DIRECTIVITY AND ADAPTATION AND RELEVANT MICROSTRIP COUPLER

[75] Inventors: Enzo C. D'Oro, Monza; Lorenzo Miglioli, Piacenza; Massimo Rivolta, Agrate Brianza, all of Italy

[73] Assignee: Forem S.P.A., Italy

[21] Appl. No.: 893,709

[22] Filed: Jun. 5, 1992

[30] Foreign Application Priority Data

Jun. 11, 1991 [IT] Italy ..... M191 A 001607

[51] Int. Cl.[5] ..... H01P 5/18

[52] U.S. Cl. ..... 333/116; 333/238

[58] Field of Search ..... 333/116

[56] References Cited

U.S. PATENT DOCUMENTS

| | | | |
|---|---|---|---|
| 3,512,110 | 5/1970 | Clar | 333/116 |
| 3,593,208 | 7/1971 | Smith . | |
| 3,849,743 | 11/1974 | Treczka . | |
| 4,375,054 | 2/1983 | Pavio | 333/116 |
| 4,376,921 | 3/1983 | Dickens et al. | 333/116 |
| 4,394,630 | 7/1983 | Wayne et al. | 333/116 |
| 4,999,593 | 3/1991 | Anderson | 333/116 X |

FOREIGN PATENT DOCUMENTS

| | | | |
|---|---|---|---|
| 2129899 | 11/1972 | France . | |
| 2419613 | 10/1979 | France . | |
| 62402 | 5/1981 | Japan | 333/116 |
| 1417083 | 8/1988 | U.S.S.R. | 333/116 |
| 2106720 | 4/1983 | United Kingdom . | |

OTHER PUBLICATIONS

Patent Abstracts of Japan, vol. 9, No. 43 (E-298) [1766], 22 Feb. 1985 (abstract of JP-A-59 182 601 (Fujitsu K.K.) 17 Oct. 1984).

*Primary Examiner*—Paul Gensler

*Attorney, Agent, or Firm*—Ostrolenk, Faber, Gerb & Soffen

[57] ABSTRACT

A method for increasing the directivity and adaptation of directive microwave couplers formed of two spaced apart lines, in which the length of each line is reduced to a value of less than one quarter of the operating wavelength. Capacitance is added to the coupler to counter the reduction of capacitance resulting from the shortened lines. The capacitance is added by: (1) increasing the surface area of the shortened lines by adding lateral pads; and (2) providing a dielectric bridge across the pads.

5 Claims, 2 Drawing Sheets

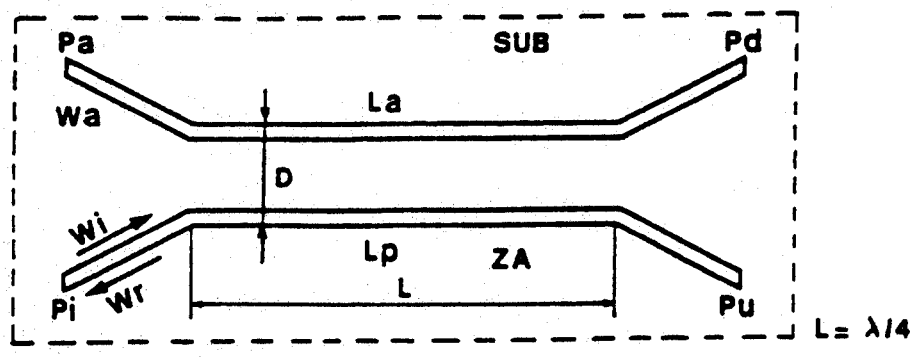
Fig.1 *PRIOR ART*
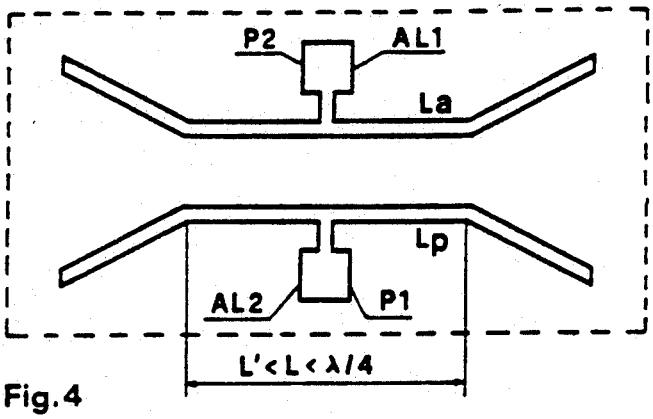
Fig.4
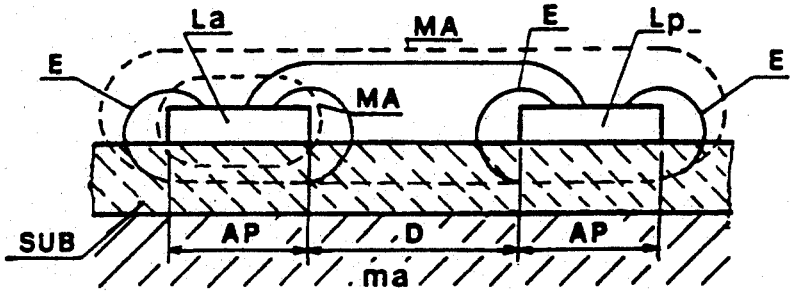
Fig.2 *PRIOR ART*
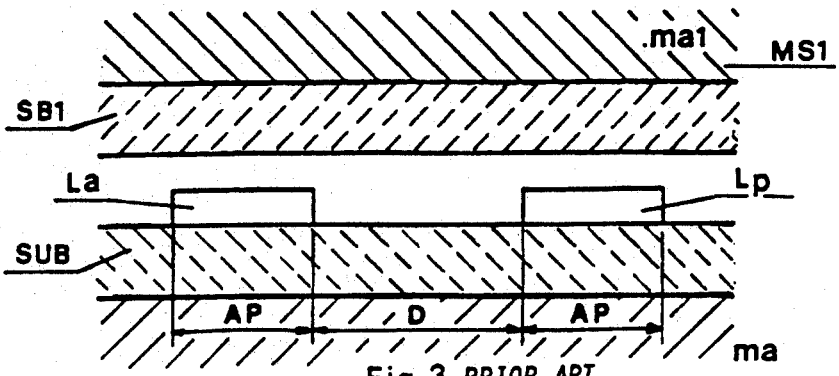
Fig.3 *PRIOR ART*

METHOD TO MAKE MICROWAVE COUPLER WITH MAXIMAL DIRECTIVITY AND ADAPTATION AND RELEVANT MICROSTRIP COUPLER

BACKGROUND OF THE INVENTION

1. Field of the Invention

The present invention relates to a method for maximizing the directivity and adaptation of directive microwave couplers, operating, for example, at frequencies between a few hundreds of Megahertz and several tens of Gigahertz, and consisting of a network with four terminals formed by two mutually coupled lines so as to impart directivity to the coupling.

2. Description of the Related Art

Couplers for microwave signals are widely used, most often in the telecommunications applications. Known couplers typically consist of a network of two mutually coupled lines, each having two terminals. FIG. 1 shows the classical scheme of such a coupler, in which Lp and La represent the main line and the coupled line respectively, while Pi, Pu, Pa, Pd identify the inlet (Pi) terminal and the opposite (Pu) terminal on the line La. In general, the lines are disposed on a dielectric substrate SUB. The lines each have a width AP and a length $L=\frac{1}{4}\lambda$, and are at a distance D from each other.

Still referring to FIG. 1, Wi represents the inlet power in the gate Pi, while Wa represents the outlet power of the coupler terminal Pa, with Wd representing the power at the output of the uncoupled terminal Pd, and Wr the power acted upon by the coupler and outgoing from the inlet terminal.

The coupler functions in accordance with following definitions:

Coupling Acc=Wi/Wa

Directivity DIR=Wa/Wd

Adaptation AD=Wi/Wr

With continued reference to FIG. 1, the parameters utilized to obtain the desired coupling (Acc) and simultaneously to have maximum values of directivity (DIR) and adaptation (AD) are the widths (AP) of lines Lp and La and the distance D between the lines.

The length L of the coupled zone (ZA) determines the frequency field in which the coupling (Acc) becomes flat and, as stated previously, L is set equal to a quarter of the wavelength of the central frequency Fc of the working band BAL. For values of L other than $\lambda/4$ the coupling is not flat, but the directivity and the adaptation are not significantly worsened. One of the inconveniences of the described conventional structure is that the directivity is rather low and does not reach satisfactory values no matter how the width AP of the coupled lines and the distance D between the lines are varied.

This becomes understandable if one considers that there are three magnitudes or factors which must be maintained (coupling Acc, directivity DIR and adaptation AD), whereas there are only two variable parameters (width AP of the lines and interline distance D). More specifically, reference is made to FIG. 2, in which the cross-section of the coupled zone is shown. The solid lines relate to the electric field E and determine the capacitance C of the coupling Acc, while the dashed lines relate to the magnetic field MA and determine the mutual inductive coupling M. The presence of air above the coupler dielectric substrate SUB decreases the capacitance of the coupling and prevents the capacitance from attaining the optimal value it should have with respect to the mutual inductance M.

The air present above the substrate is eliminated in "strip-line" couplers in which, as shown in FIG. 3, the coupled lines Lp, La are disposed between a double substrate SUB, SB1 and a double mass plane ma, ma1.

The coupler of FIG. 3 has improved characteristics and substantially solves the above-mentioned problem; however, it has the significant inconvenience of being embodied with the complex, expensive structure of a strip-line sandwich.

SUMMARY OF THE INVENTION

An object of the present invention is to provide a system which overcomes the drawbacks of the prior art and provides, in particular, maximum directivity and adaptation without appreciably affecting the coupling and without the need for the complex structures of the "strip-line" type.

Another object of the invention is to provide couplers having high functional characteristics and embodied with particularly simple and efficient structures of the "microstrip" type.

BRIEF DESCRIPTION OF THE DRAWINGS

Various other features and advantages of the invention will become apparent from the following description of the preferred embodiment when read in conjunction with the accompanying drawings, in which:

FIG. 1 shows a typical prior art coupler;

FIG. 2 shows a cross-section of the coupled zone ZA of the coupler of FIG. 1;

FIG. 3 shows a conventional strip-line coupler;

FIG. 4 shows a longitudinal section (i.e. in the plane containing the axis of lines Lp and La) of a coupler according to the invention which is not provided with a printed circuit bridge;

DETAILED DESCRIPTION OF THE PREFERRED EMBODIMENT

Figure 4A:
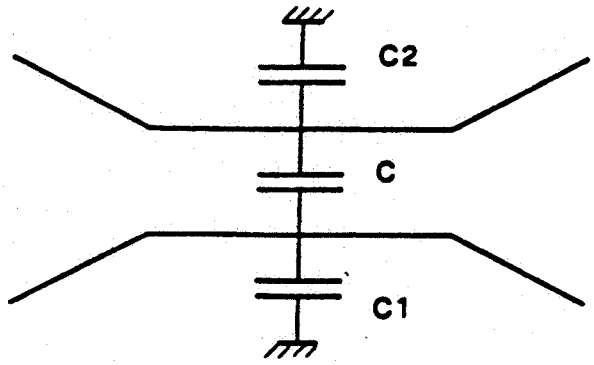
FIG. 4A shows the equivalent circuit of the structure of FIG. 4.
Figure 5:
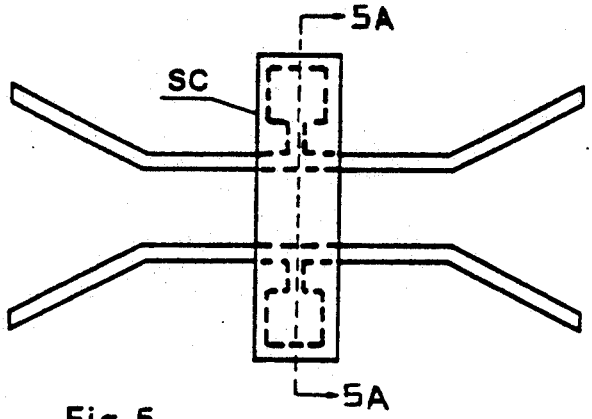
FIG. 5 is similar to FIG. 4, but shows the invention provided with the printed circuit bridge.
Figure 5A:
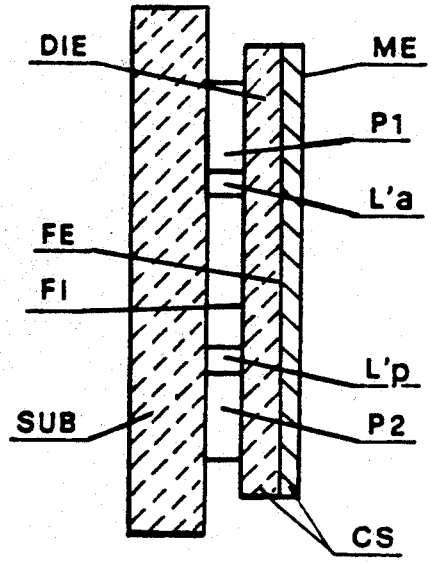
FIG. 5A is a cross-section view of FIG. 5 taken along line Y—Y.

With reference to FIGS. 4 and 5, the method of the invention consists of:

a) reducing the length of lines Lp and La in the coupler zone LA to a value $L'<\lambda/4$;

b) combining the shortening of the lines ($L'<\lambda/4$), with an increase in the capacitive coupling between the lines so as to bring the capacitance C back to the correct value and to obtain an optimal adaptation AD.

In a preferred embodiment of the invention, this increase of the coupling capacitance C back to the correct value is obtained through an increase of the surface area of same lines by providing two pads P1 and P2 in the central zone, disposed laterally to the (shortened) lines L'p and L'a.

The increase of the area of each line with the provision of at least one central pad can range from 10% to 60% of the longitudinal surface (the width AP multiplied by the new length $L'<\lambda/4$) of line L'p, and respectively line L'a, preferably an increase of area from 20% to 40% of the surface. In the equivalent circuit schematic of FIG. 4A, the additional capacitance over the mass "ma" provided by the pads is represented by C1, and respectively C2, the capacitance between the shortened lines being slightly lower than the capacitance C of the lines of normal length $L=\lambda/4$.

c) According to another feature of the invention, the two capacitances C1, C2, i.e., the two pads P1, P2, are connected to each other with a bridge SC which overlaps the lines L'a and L'p and is preferably in the form of a printed circuit CS.

Importantly, the overlap or bridge SC, in form of printed circuit CS, consists of:

a portion (which is disposed traversely to the lines) of dielectric material DIE (preferably the same dielectric material of substrate SUB), and a metalization ME on the surface remote from the pads.

Figure 5B:
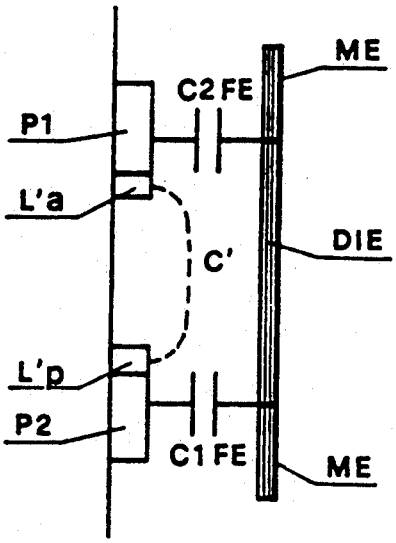
FIG. 5B shows the equivalent circuit resulting from the structure of FIGS. 5 and 5A.

The internal face FI of the dielectric DIE contacts pads P1 and P2, while the outer face of SC is the metallic layer ME. The equivalent circuit schematic of FIG. 5B shows that each pad P2, P1 forms a capacitance C1 FE, respectively C2 FE, with the metal layer ME. These capacitances are no longer in the air but now in the dielectric DIE. The same consideration applies now to the inter-line capacitance (indicated with the reference C'), which has a more advantageous value as it is also now in the dielectric, rather than in the air. It can thus be appreciated that two capacitances C1 and C2 (FIG. 4A) are introduced with respect to the mass, two capacitances are introduced between the pads P1, P2 and metal layer ME, and, moreover, the capacitance C'between the lines is increased.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

We claim:

1. A method for increasing the directivity and adaptation of directive microwave couplers operating in frequencies f ranging from a few hundred megahertz to tens of gigahertz and comprising a network formed of two lines having a width AP, spaced apart by a gap, and mutually coupled in a coupling zone of length L, where $L=\lambda/4$, $\lambda=1/f$, said method comprising the steps of:

a) reducing the length L of each line to a length $L'<\lambda/4$;

b) inserting capacitances C1 and C2, respectively, from each of said lines to ground, said capacitances C1 and C2 being disposed outside of and away from said gap; and c) adding an additional capacitance C in said gap bridging said capacitances C1 and C2.

2. A method as recited in claim 1, further comprising the step of increasing the area of each line L by 10% to 60%.

3. A method as recited in claim 1, further comprising the step of increasing the area of each line L by 20% to 40%.

4. A method as recited in claim 1, wherein said step of adding said additional capacitance C is accomplished by bridging said lines with a dielectric having an outer metal layer.

5. A coupler for implementing the method of claim 1, comprising two lines La, Lp, each having a width AP and a length $L'<\lambda/4$, said lines being disposed on a dielectric substrate, said lines having portions contacted by two metallic pads coupled by a bridge comprising a dielectric body, said dielectric body having, on a surface opposite said pads, a metallic layer capacitively coupled with said pads and with portions of said lines contacted by said pads and disposed under said bridge.

* * * * *